United States Patent [19]

Barton et al.

[11] 4,339,099

[45] Jul. 13, 1982

[54] DEVICE FOR HOLDING AND SPREADING TRASH BAGS

[76] Inventors: C. Dickinson Barton, 236 W. 54th St., Kansas City, Mo. 64112; Glen Maurer, Regent's Walk Apartments, 91st & Riggs La., Apt. 9115, Shawnee Mission, Kans. 66212

[21] Appl. No.: 81,900

[22] Filed: Oct. 4, 1979

Related U.S. Application Data

[63] Continuation-in-part of Ser. No. 854,609, Nov. 25, 1977, abandoned.

[51] Int. Cl.[3] ..... B65B 67/04

[52] U.S. Cl. ..... 248/101

[58] Field of Search ..... 248/94, 95, 99, 101, 248/226.5, 274, 231, 313, 316 D; 24/137 R, 139.1

[56] References Cited

U.S. PATENT DOCUMENTS

| | | | |
|---|---|---|---|
| 878,727 | 2/1908 | Harris et al. | 24/139.1 |
| 1,214,761 | 2/1917 | Craig | 248/99 |
| 1,224,568 | 5/1917 | Ream | 248/99 X |
| 1,228,333 | 5/1917 | McBurney | 248/99 X |
| 1,378,607 | 5/1921 | Norton | 248/99 X |
| 1,483,592 | 2/1924 | Pelstring | 248/231 X |
| 1,621,720 | 3/1927 | Harper | 248/226.5 X |
| 1,928,844 | 10/1933 | Seibert | 248/99 X |
| 2,558,768 | 7/1951 | McCormick | 248/231 |
| 3,779,496 | 12/1973 | Welles | 248/99 |
| 3,847,332 | 11/1974 | Murai | 248/99 |
| 3,912,208 | 10/1975 | Grenetier | 248/99 |
| 3,916,962 | 11/1975 | Stolt | 248/101 X |
| 4,023,842 | 5/1977 | Harvey | 248/99 X |
| 4,069,993 | 1/1978 | Shanks | 248/101 X |

FOREIGN PATENT DOCUMENTS

| | | | |
|---|---|---|---|
| 679189 | 2/1964 | Canada | 248/226.5 |

*Primary Examiner*—William H. Schultz

*Attorney, Agent, or Firm*—Kokjer, Kircher, Bradley, Wharton, Bowman & Johnson

[57] ABSTRACT

A device which attaches a large flexible trash bag to a convenient support in a manner to hold open the mouth of the bag. In one embodiment the device includes a looped coil spring mounted to and extending from one side of a spreader bar by a removable clip that permits the effective length of the spring to be adjusted. With the upper side portion of the bag draped over the doorknob, the spring is stretched onto the knob to securely attach the bag to the knob with the spreader bar located down in the bag to hold open its mouth. The spreader bar also includes two longitudinally spaced generally U-shaped spring clamps projecting from that side of the bar opposite the spring loop. A portion of the bag at the open end can be draped over the horizontal handle portion of a power lawn mower or snow blower, and the clamps slipped over the draped bag portion thereby to cause the bag to adhere to the handle in spread fashion. In another embodiment only a spreader bar and the clamps are used.

9 Claims, 7 Drawing Figures

DEVICE FOR HOLDING AND SPREADING TRASH BAGS

This is a continuation in part of application Ser. No. 854,609, filed Nov. 25, 1977 now abandoned.

BACKGROUND AND SUMMARY OF THE INVENTION

This invention relates generally to the handling of trash bags and deals more particularly with a device used to attach a bag to a conveniently available support in a manner to spread open and support the mount of the bag.

It has become common practice, in large part because of governmental regulations, for household trash to be collected in large plastic bags. It is thus necessary in many homes, apartments and offices for a large trash bag to be carried from room to room so that the contents of waste baskets and relatively small garbage pails can be emptied into the bag. Since two hands are insufficient to support and to hold open the bag while at the same time emptying the contents of a waste basket or the like into it, this task cannot easily be accomplished by one person without spilling trash on the floor.

It has also become common practice in such outdoor tasks as lawn mowing, leaf gathering, hedge clipping and the like to utilize plastic bags for collection and disposal. Similar problems accompany the loading of the bags outdoors.

In recognition of the difficulty involved in emptying waste baskets and other containers into large trash bags and otherwise filling the bags, various types of mechanical devices have been developed to assist in this chore. However, these devices have been unsatisfactory in many respects. Large wire frames and plastic or metal barrels are typically employed to receive the bag and to hold its mouth open so that trash can be received therein. These frames and barrels are overly expensive, too large to conveniently store in many households, and too heavy and awkward to easily carry between rooms or up and down stairs. Moreover, considerable time is required to properly arrange the trash bag in devices of this type.

It is an object of the present invention to provide a simple and economical device which is capable of utilization with a variety of domestically available surfaces to support a flexible trash bag on one side with its mouth held open in order to permit a waste basket or the like to be easily emptied into the bag by a single person. Since the device securely holds one side of the bag, the opposite side can be grasped with one hand and pulled taut to fully open the mount of the bag while the other hand is used to empty the waste basket.

Another object of the invention is to provide a device of the character described which serves to attach the bag either to a common doorknob, thereby permitting it to be used conveniently in virtually any room and taking advantage of the doorknob shape to assure a firm grip of the bag, or to the handle of a power lawn mower, snow blower or the like, taking advantage of the shape and orientation of the handle to obtain both the spreading of the bag and retention therein.

Yet another object of the invention is to provide a device of the character described which may be quickly and easily attached to the doorknob or handle and detached therefrom, and which is adjustable in order to accommodate doorknobs or handles of various sizes and styles. In the latter respect, with respect to doorknobs the length adjustment of the spring is important in that it allows the device to fit on different types of doorknobs, in addition to compensating for any permanent set of the spring that may occur after prolonged use.

An additional object of the invention is to provide a device of the character described which locates the bag at a convenient height, which does not tear or otherwise damage the bag and which firmly supports the bag even when it is weighted down with trash.

A further object of the invention is to provide a device of the character described which is small and easy to handle, conveniently stored when not in use, light in weight, and which utilizes the bag material in a manner to avoid scratching the door or its hardware.

Other and further objects of the invention, together with the features of novelty appurtenant thereto, will appear in the course of the following description.

DETAILED DESCRIPTION OF THE INVENTION

In the accompanying drawing, which forms a part of the specification and is to be read in conjunction therewith and in which like reference numerals are used to indicate like parts in the various views.

Figure 1:
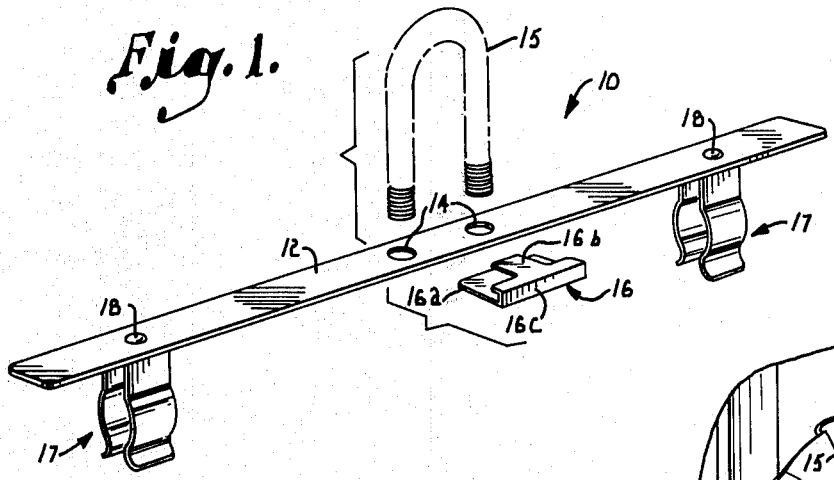
FIG. 1 is an exploded perspective view of a device constructed in accordance with the preferred embodiment of the present invention.
Figure 2:
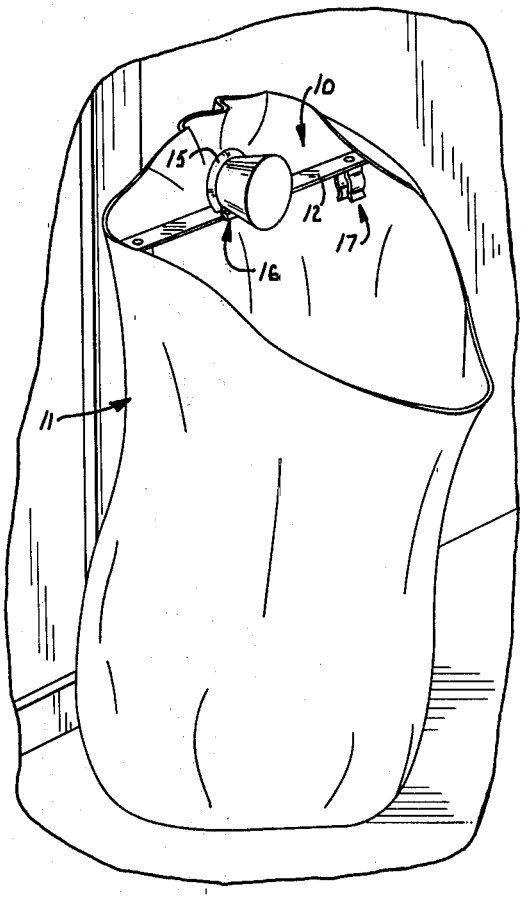
FIG. 2 is a perspective view showing the device applied to a doorknob in a manner to spread open the mouth of a flexible trash bag.
Figure 3:
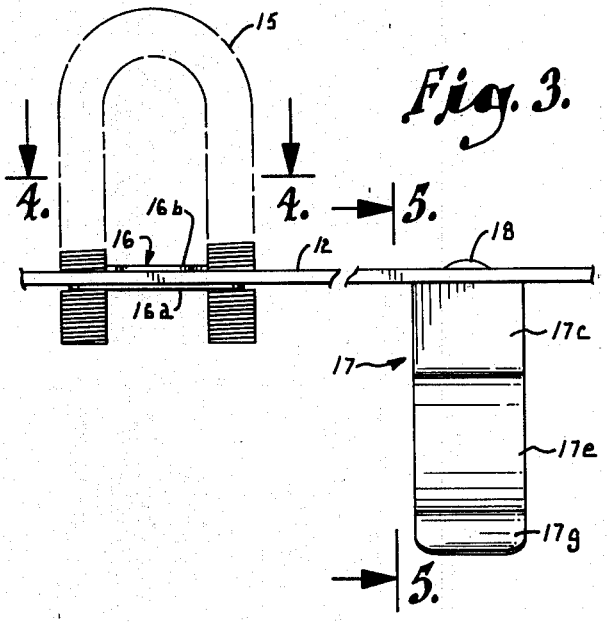
FIG. 3 is a fragmentary side elevational view of the device.

Referring now to the drawing in detail, and initially to the embodiment shown in FIGS. 1–5, numeral 10 generally designates a device which is used to spread open the mouth of a large flexible trash bag 11 (FIG. 2). Bags of this type are normally in the form of a thin plastic film such as polyethylene or a similar substance having relatively smooth and slippery surfaces. The device 10 includes a flat spreader bar 12 which is preferably aluminum stock approximately 11 or 12 inches long. Bar 12 has flat opposite sides and is preferably rounded somewhat on its corners.

A pair of spaced apart openings 14 are formed near the center of bar 12 to receive the opposite end portions of a relatively stiff coil spring 15 which is arranged in a loop shaped generally in the manner of an inverted "U". The ends of spring 15 extend through openings 14 and are attached to bar 12 by clip member 16 that may also be aluminum.

As shown in FIG. 1, a metal clip 16 includes a rectangular lower plate **16*a* which bears flatly against the lower surface of bar 12 when the clip is applied thereto. The dimensions of plate 16 are such that its opposite ends substantially cover each of the openings 14. Consequently, when the clip is mounted to bar 12, the end portions of plate 16***a* pass between adjacent coils of each end portion of spring 15. One of these coils is located substantially within each opening 14, while the other coil underlies plate 16*a*. Due to the spring force, the coils underlying plate 16*a* firmly press it upwardly against the underside of bar 12 to thereby securely hold clip 16 on the bar and prevent the ends of spring 15 from passing through openings 14. As a result, spring 15 and clip 16 are firmly yet releasably mounted on bar 12.

Figure 4:
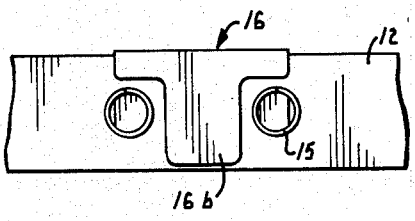
FIG. 4 is a fragmentary view taken generally along line 4–4 of FIG. 3 in the direction of the arrow.
Figure 5:
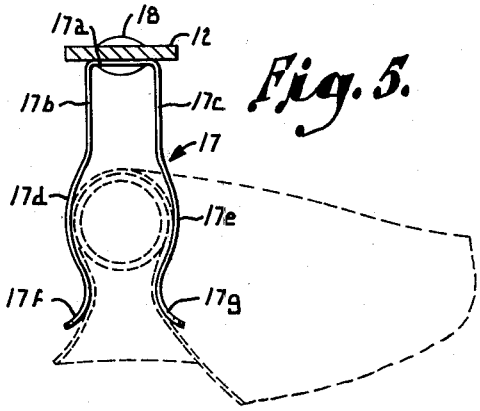
FIG. 5 is a sectional view taken along the line 5–5 of FIG. 3 in the direction of the arrows.

Clip 16 also includes a flat upper plate 16*b* which is connected with plate 16*a* by a connecting portion 16*c* that fits over the edge of bar 12. Portion 16*c* maintains plates 16*a* and 16*b* spaced apart from and parallel to one another. Plate 16*b* flatly contacts the upper surface of bar 12 to assist in maintaining the clip on the spreader bar. Plate 16*b* is necked down so that it is located within the loop presented by spring 15 without contacting the spring, as shown in FIG. 4.

Also attached to the spreader bar and extending from the side opposite that of the loop of spring 15 is a pair of generally U-shaped spreading clamps 17. The clamps are identical, each comprising a flat bright portion 17*a* and generally parallel legs 17*b*, 17*c*. The legs have opposed arcuate bends 17*d*, 17*e* confronting one another and terminate in the flared ends 17*f*, 17*g* at the open end of the clamp.

The spring clamps, which are made of good quality spring steel or other suitably resilient material, are attached to the spreader bar by rivets 18. The riveted connection should be firm but still loose enough to permit twisting of the clamps on their rivet axis for a purpose later to be set forth.

In one mode of use, the device serves to attach a trash bag such as the flexible plastic bag 11 to an ordinary doorknob 19, while at the same time holding open the mouth of the bag so that trash can be dumped into it from waste baskets and the like. The upper side portion of bag 11 is initially draped over knob 19 with the upper edge of the bag located approximately 6 inches above the knob. The looped coil spring 15 is then stretched over the knob and onto its reduced diameter neck, and around the portion of the bag which is draped over the rack, as shown in FIG. 2. When spring 15 has passed knob 19, it contracts around the neck and remains under tension. The spring thus acts to firmly hold the plastic film of bag 11 around the neck of the knob. The tension of spring 15, in cooperation with the large surface area of the bag in contact with the doorknob 19, provides sufficient friction and surface tension to prevent the bag from slipping on the knob even when it is weighted down with trash. Normally, the bottom of the bag is located above floor.

It is pointed out that the height of the common doorknob locates the mouth of bag 11 at the ideal position; i.e., approximately waist high or slightly below. It is further pointed out that the shape of the knob assists greatly in preventing the bag from slipping. In this regard, the film material engaged by spring 15 is bunched up somewhat on the neck due to its small size in comparison to the knob, and this portion of the bag is not able to easily slip since to do so it must expand sufficiently to pass the relatively large knob. In addition, the surface tension provided by the large surface area of the bag film that covers the knob cooperates with the gripping action provided by spring 15 to prevent slippage of the bag without tearing or otherwise damaging it. It is also significant to recognize that the inner surface of the knob provides a shoulder area against which spring 15 acts to further increase the area of contact between the spring and bag, thereby increasing the holding force.

Since the exterior surface of spring 15 is smoothly curved, it does not tend to tear the bag when being slipped onto knob 19. The tension and length of the spring are also highly important. If the spring is too weak, a heavily loaded bag may slip off of the knob. Conversely, if the spring is overly strong, it is difficult to slip over the knob and tends to tear the bag when forced on.

When the device is thus applied to bag 11 and knob 19, spreader bar 12 extends horizontally within the mouth of the bag in a manner to maintain the mouth open for the receipt of trash. Since the upper edge of the bag is elevated well above the knob, bar 12 is located down in the bag such that the upper part of the bag drapes over the spreader bar as the bag is pulled tautly at point 11*a*. The draping of the bag film over the end portions of bar 12 prevents the upper bag edge from slipping off of the bar and thus effectively holds open the mouth of the bag. Due to the spreading action of the bar, one hand is free to hold the outer side of bag 11 at point 11*a* while the other hand may be used to empty the waste basket into the open mouth of the bag.

The device 10 may be easily removed from the knob by simply pulling if off of the knob in order to free bag 11. The spreader bar 12 provides a convenient handle which, when pulled outwardly away from the knob and then slightly upwardly, easily pulls the looped spring 15 off of the knob. The bag may then be carried off to a new location, and the device may be carried in the pocket or in any other convenient fashion.

The length of spring 15 is initially set such that it will fit with the required tension on most doorknobs. However, in order to vary the effective length of the loop provided by spring 15, clip 16 may be removed by sliding it off of bar 12. The ends of the spring may then be adjusted up or down to lengthen or shorten the loop. Clip 16 is thereafter applied to bar 12 agains such that spring 15 is held in its new position. In this manner, adjustment of the spring may be accomplished in order to accommodate various sizes and styles of doorknobs, and also to compensate for any permanent set in the spring. It is further noted that bag 11 effectively insulates the entirety of the device from contact with the door or its associated hardware, including knob 19, thereby preventing scratches or other damage. Since the invention takes advantage of the common doorknob, it is extremely versatile in that it may be used effectively in virtually any room.

Figure 7:
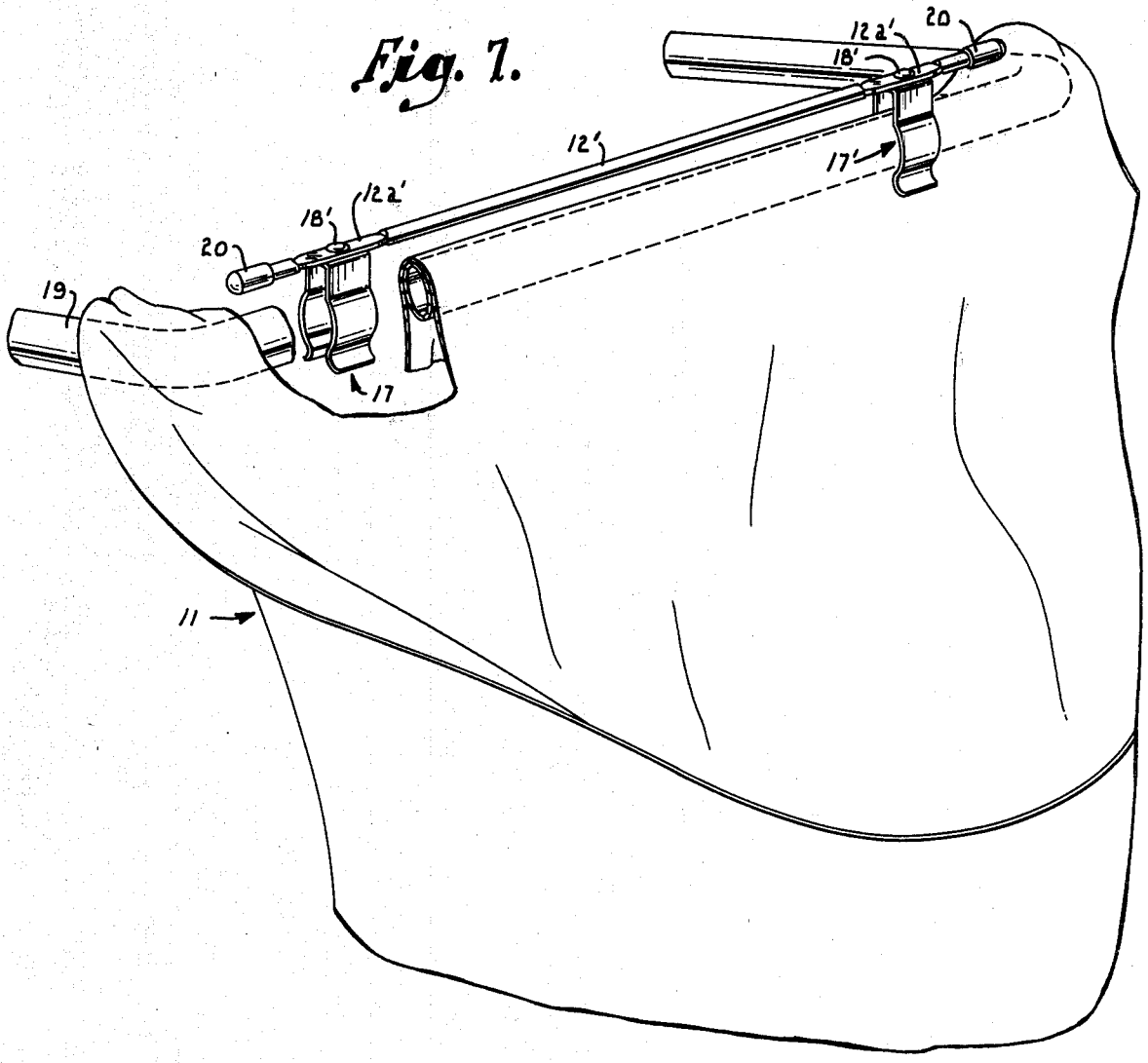
FIG. 7 is a perspective view showing the manner of application of the embodiment of FIG. 6 in mounting a bag to an appliance handle, parts being broken away for purposes of illustration.

In another mode of use the device is utilized in combination with the horizontal crossbar of handle of a conventional power mower or snow blower or similar appliance to attach the bag to and support it on the handle. While shown in conjunction with another embodiment of the invention, FIG. 7 illustrates a typical manner of application. The bag 11 is positioned with one side adjacent the open end draped over the crossbar or handle 19. The spring clamps are then slipped down over the draped over portion, as illustrated both in FIG. 7 and in FIG. 5, thereby to firmly engage the draped portion around the cross bar.

It is important to know that the radius of curvature of the bowed portions 17*d*, 17*c* of the clamp is greater than that of the largest average diameter for a handle to be encountered. We have found that the general range of diameters runs from about $\frac{3}{4}''$ to approximately 1", so the radius of curvature of the bows is in excess of 0.5". Also, the maximum lateral dimension between the legs 17*d*, 17*e* is about $\frac{5}{8}$". The purpose of this is to insure that the clamps make more of a line contact with the bag surface rather than an area contact. In other words, the bag is firmly gripped by line contact at two points on opposite sides of the handle. This insures of a firm grip on the plastic material of the bag. When gripped in this fashion the bag itself assists in holding itself to the handle by reason of the frictional interplay between the bag surface and the handle surface.

It will be noted that the length of the straight portions of the clamp legs 17*b*, 17*c* adjacent the bight is sufficient that the projecting ends of the spring loop 15 do not come into contact with or otherwise interfere with the draped over bag. It also provides sufficient space between the draped bag and spreader bar for the fingers of a user to easily manipulate the device for installation and removal.

In the event the crossbar or handle is not straight, the clamps 17 can be twisted on the axes of their rivets 18 to properly align them with the handle.

Figure 6:
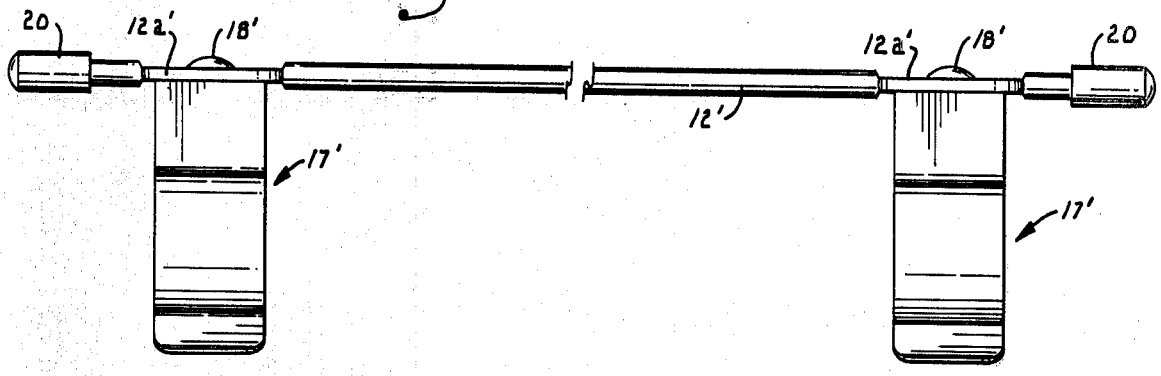
FIG. 6 is a side elevational view of another embodiment of the invention, parts being broken away to indicate interrupted length.

In the modified form of the invention as shown in FIGS. 6 and 7 the spreader bar in this case comprises a cylindrical rod 12' having the two flattened portions 12*a*, 12*b*, near the opposite ends. The ends of the rod are capped with protective caps 20 which may be made of plastic, rubber or other suitable material.

The clamps 17' are secured to the flat portions by the rivets 18' in the same fashion as earlier described.

The action of the modified form of the invention in clamping the bag to the crossbar 19 is as described above. As will be evident the modified version does not include the spring combination, but, being constructed of rod, is more compact and lends itself to production at a lower cost and to storage or transport in more restricted space than is possible with the preferred embodiment.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described our invention, we claim:

1. Apparatus for supporting above ground or floor level and simultaneously spreading and holding spread a substantial portion of the bag wall at the mouth of a flexible bag so that the unsupported portion of the bag wall adjacent the mouth can be drawn away from the supported and spread portion thereby to open the mouth of the bag for reception of material, said apparatus comprising, in combination, an elevated support member located above ground or floor level and having a bag draping surface over which a portion of the exterior bag wall adjacent the bag mouth can be draped and conformed thereto with a substantial portion of the bag wall in surface to surface contact with the bag draping surface, and combined bag gripping and spreading means having parts engageable over the outside of the draped surface to grip and maintain the draped surface in support contacting condition during opening of the bag mouth and loading of the bag, said combined means including an integral spreader bar operable to cause a substantial segment of the bag wall to remain stationary when the unsupported portion is drawn away from the supported portion thereby to open the mouth of the bag.

2. The combination as in claim 1, said gripping and spreading means including a resilient loop centrally located on said spreader bar.

3. The combination as in claim 1, said gripping and spreading means including a pair of generally U-shaped clamps having bight portions attached to said spreader bar, said claims spaced from one another lengthwise of the spreader bar.

4. The combination as in claim 1, said gripping and spreading means including a resilient loop centrally located on said spreader bar and extending laterally therefrom and a pair of generally U-shaped clamps having bight portions attached to said spreader bar, said clamps spaced from one another lengthwise of the spreader bar and extending laterally from the spreader bar in a direction opposite to that of said resilient loop.

5. The combination as in claim 1, wherein said support member comprises a generally horizontally extending doorknob, said gripping and spreading means comprising a resilient loop centrally located on said spreader bar, said loop adapted to fit around the knob and draped bag portion with the spreader bar inside the bag and extending to opposite sides thereof.

6. The combination as in claim 5, including means for adjusting the effective length of said resilient loop thereby to accommodate knobs of various sizes.

7. The combination as in claim 6, wherein said resilient loop is in the form of a coil spring having opposite end portions extending through openings in said spreader member, and including adjustable means for securing said end portions to said spreader member in a manner to permit adjustable variation in the effective length of said coil spring.

8. The combination as in claim 7, wherein said adjustable means includes a plate member releasably mounted on said spreader bar at a location to extend between adjacent coils of the respective end portions of spring, thereby securing said end portions to said spreader bar.

9. The combination as in claim 8, wherein said adjustable means includes a clip releasably mounted on said spreader bar and comprising:

a first plate portion contacting one side of said spreader bar and passing between the adjacent coils of the respective end portions of said spring to attach said end portions to said spreader bar; and a second plate portion contacting an opposite side of said spreader bar and connected with said first plate portion in a manner to cooperate therewith and releasably mounting said clip on said spreader bar.

* * * * *